US010048033B1

(12) United States Patent
Lee

(10) Patent No.: US 10,048,033 B1
(45) Date of Patent: Aug. 14, 2018

(54) DEVICE FOR DAMPENING RESIDUAL EFFECTS FROM A FIREARM SUPPRESSOR

(71) Applicant: Darryl S. Lee, Fort Myers, FL (US)

(72) Inventor: Darryl S. Lee, Fort Myers, FL (US)

( * ) Notice: Subject to any disclaimer, the term of this patent is extended or adjusted under 35 U.S.C. 154(b) by 0 days.

(21) Appl. No.: 15/819,893

(22) Filed: Nov. 21, 2017

(51) Int. Cl.
*F41A 21/34* (2006.01)
*F41A 21/44* (2006.01)
*F41A 21/30* (2006.01)

(52) U.S. Cl.
CPC ..... *F41A 21/34* (2013.01); *F41A 21/44* (2013.01); *F41A 21/30* (2013.01)

(58) Field of Classification Search
CPC ..... F41A 21/34; F41A 21/44; F41A 21/325; F41A 21/30
See application file for complete search history.

(56) References Cited

U.S. PATENT DOCUMENTS

2015/0184968 A1* 7/2015 Fischer ..... F41A 21/30 89/14.4

FOREIGN PATENT DOCUMENTS

EP 2615403 A2 * 7/2013 ..... F41A 21/30
WO WO-2009139803 A2 * 11/2009 ..... F41A 21/30

* cited by examiner

*Primary Examiner* — Stephen Johnson
(74) *Attorney, Agent, or Firm* — Nicholas Pfeifer; Smith & Hopen, P.A.

(57) ABSTRACT

A universal firearm shield adapted to attach to a firearm suppressor. Suppressors fail to dampen all of the effects of firearm discharge, leaving behind residual effects that may be noticeable. The shield dampens the residual effects of firearm discharge that are not captured by the suppressor. The residual effects are captured by the shield and dispersed throughout one or more interior chambers. The shield easily, quickly, and securely couples to suppressors of varying geometries due to the slidably adjustable components of the shield. The shield is configured to surround the suppressor and axially align with the suppressor. As such, the muzzle of the firearm axially aligns with the shield, the suppressor, and the barrel for an unobstructed projectile path during discharge.

15 Claims, 7 Drawing Sheets

DEVICE FOR DAMPENING RESIDUAL EFFECTS FROM A FIREARM SUPPRESSOR

BACKGROUND OF THE INVENTION

1. Field of the Invention

This invention relates, generally, to firearm suppressors. More specifically, it relates to an adjustable sound, light, and heat shield configured to mount to a suppressor on a firearm and axially align with the firearm barrel.

2. Brief Description of the Prior Art

Increased use of firearms has led to a desire to dampen the audible and visual effects associated with firearms. The suppression of sound, light, and heat from firearms is especially important in law enforcement and military operations. For example, it may be desirable for military personnel to remain hidden during an operation to prevent alerting an enemy combatant of their locations. Such military personnel often use firearm suppressors to remain hidden while discharging their weapons. Similarly, people often use suppressors when shooting targets on their property to prevent firearm noise from becoming a nuisance to neighbors. Hunters also use suppressors to prevent alerting animals of their presence.

Typically, firearm suppressors quiet the report of discharge to a safe level of less than 140 decibels. The resulting decibel level of suppressed gunfire is safer than unsuppressed gunfire, but can still be uncomfortably loud or even dangerous to a listener. This problem is especially present in interior combat situations, because the soundwaves created by gunfire ricochet against the walls, floor, and ceiling of an interior area, potentially causing hearing problems.

While gunfire reduced to 140 decibels is usually considered a safe degree of loudness, the suppressors may still fail to mask the presence of law enforcement or military personnel to a hostile party. The hostile party may become aware of an officer despite the use of a suppressor, placing the officers in great danger. Similarly, the noise generated despite the use of a suppressor can be bothersome to a hunter, as it can alert animals of the presence of the hunter.

The audible effects generated by a firearm during discharge include vibrational and acoustical soundwaves. When a firearm is discharged, vibrational and acoustical soundwaves travel through the barrel and escape from the firearm, leading to an audible noise. However, remnant effects of suppressed gunfire exist even with the use of a firearm suppressor. Suppressors fail to contain all of the vibrational soundwaves resulting from a firearm discharge. Instead, remnant vibrational soundwaves result from the contact between exploding blast gasses and the body of the suppressor. The vibrational soundwaves transfer through the body of the suppressor and radiate into the environment exterior to the suppressor. As such, the suppressor radiates vibrational soundwaves, which can alert a party of the presence of a firearm. Similarly, residual acoustical soundwaves escape the bore of the suppressor after a bullet is discharged through the suppressor bore. As the explosion of blast gas grows within the interior of the suppressor, the expanding gases are forced from the larger interior chamber of the suppressor, through the narrow aperture of the distal bore of the suppressor. When this occurs, the gases increase in velocity, and the corresponding acoustical soundwaves are amplified as they escape into the exterior environment.

Firearms also generate visual effects during discharge, including light and heat energy. The light and heat discharged by a firearm are partially dampened by a suppressor. The light energy results from the burning of propellant gas as a bullet leaves the barrel of the firearm. The hot gas reacts with the surrounding air at the muzzle of the gun, creating a flash of light referred to as the "muzzle blast" of the discharge. While suppressors capture some of the light from the reaction, some of the light energy escapes through the bore of the suppressor. The residual light is especially dangerous during low-light conditions, since the light contrasts with the darkness of the environment. Such light discharge can be deadly to law enforcement or military personnel if noticed by a hostile party.

Similarly, the burning of propellant gas generates heat energy that can exceed temperatures of 3,000° Fahrenheit. Suppressors are designed to absorb the heat generated from the high-temperature explosion resulting from gunfire, retaining the heat until the suppressor cools. However, residual heat can escape from the firearm during discharge, which can alert a party of the presence of a weapon. Equally dangerous is the heat signature of the suppressor upon absorption of heat after discharge. Since the suppressor is adapted to absorb and retain heat, the radiated heat can be detected by a hostile party, either through the naked eye or specialized electronic equipment. Again, the detection of the heat signature can be deadly to law enforcement or military personnel.

Accordingly, what is needed is a shield that can decrease the sound, light, and heat associated with the discharge of a firearm, despite the use of a suppressor. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an adjustable sound, light, and heat shield configured to mount to a suppressor on a firearm and axially align with the firearm barrel is now met by a new, useful, and nonobvious invention.

The novel structure includes a residual effect shield used in combination with a firearm suppressor. The shield includes a proximal enclosure and a distal enclosure. The proximal enclosure has a proximal end, a distal end, and a body disposed therebetween. The proximal end includes an aperture sized to receive a portion of a firearm barrel.

The distal enclosure includes a distal end, a proximal end, and a body extending therebetween. The distal end includes a projectile aperture. A tapered structure is disposed within the body and longitudinally-spaced from the distal end to create a distal chamber. The tapered structure includes a proximal inner diameter that is greater than a distal inner diameter. As such, the tapered structure may be frustoconical in shape. The tapered structure is adapted to mate with the firearm suppressor, thereby aligning the firearm suppressor with the firearm barrel and the projectile aperture. In an embodiment, the tapered structure includes comprises a fluidic channel extending therethrough. The fluidic channel enables fluid in the distal chamber to pass through the tapered structure.

The proximal and distal enclosures are configured to attach to each other in an axially aligned configuration. Each of the proximal and distal enclosures include an inner diameter that is greater than an outer diameter of the firearm suppressor. At least some of the residual effects of a firearm discharge are dispersed throughout the proximal and distal enclosures.

In an embodiment, the proximal and distal enclosure include complementary threading. As such, the proximal and distal enclosures are adapted to threadedly mate via the complementary threading.

In one embodiment, the proximal and distal enclosures are housed within an enclosure. An interior surface of the enclosure and an exterior surface of both the proximal and distal enclosures include complementary threading. Accordingly, the enclosure threadedly engages with the proximal and distal enclosures via the complementary threading.

An interception device may be disposed adjacent to the projectile aperture. The interception device is tapered such that a distal diameter is greater than a proximal diameter. The interception device is adapted to direct the residual effects of the firearm discharge away from the projectile aperture and into the distal chamber.

An embodiment of a residual effect shield used in combination with a firearm suppressor includes an enclosure housing a compression sleeve, a spring, and an alignment partition. The enclosure includes a proximal end, a distal end, and a body disposed therebetween. The distal end includes a projectile aperture. The body may include a threaded portion.

The enclosure may include an interior receipt having an outer diameter that is smaller than an inner diameter of the enclosure. The different in diameters creates a translation channel between the enclosure and the interior receipt. The translation channel is in fluid communication with the chamber, thereby enabling fluid in the chamber to disperse into the translation channel.

The compression sleeve includes a proximal end, a distal end, and a body extending therebetween. The proximal end includes an aperture sized to receive a portion of a firearm barrel. The proximal end also includes at least one attachment arm adapted to translate in a radial direction to grip a proximal end of the firearm suppressor. Accordingly, the compression sleeve is adapted to exert a force against the firearm suppressor in an axial direction toward the distal end of the enclosure. The distal end of the compression sleeve is in communication with the body of the enclosure. In an embodiment, the distal end of the compression sleeve includes a threaded portion complementary to the threaded portion of the enclosure. As such, the compression sleeve is adapted to threadedly engage with the enclosure.

The spring is disposed at the distal end of the enclosure, the spring adapted to exert a force against the alignment partition in an axial direction toward the proximal end of the enclosure.

The alignment partition is disposed within the body of the enclosure and longitudinally-spaced from the distal end of the enclosure via the spring thereby creating a chamber. Accordingly, the alignment partition is adapted to contact a distal end of the firearm suppressor. At least some of the residual effects of a firearm discharge are dispersed throughout the chamber. The compression sleeve and the alignment partition are configured to align the firearm suppressor with the firearm barrel and the projectile aperture. The alignment partition may be adapted to axially translate along the translation channel formed by the interior receipt of the enclosure.

In an embodiment, the alignment partition includes a tapered structure. The tapered structure has a proximal inner diameter that is greater than a distal inner diameter. The tapered structure is configured to engage with the distal end of the firearm suppressor. The distal inner diameter is greater than or equal to an outer diameter of the firearm suppressor. The tapered structure may be frustoconical in shape, such that the tapered structure is adapted to align the firearm suppressor with the firearm barrel and the projectile aperture.

In one embodiment, the alignment partition includes a fluidic channel extending therethrough, thereby enabling fluid in the chamber to pass through the alignment partition.

An embodiment of the present invention is a novel method for dampening residual effects of a firearm discharge from a firearm suppressor. The method includes enclosing a firearm suppressor within a shield, with the firearm suppressor attaching to a portion of a firearm barrel. The shield includes a proximal portion opposite a distal portion. The distal portion includes a tapered structure longitudinally-spaced from a projectile aperture. The tapered structure has a proximal inner diameter that is greater than a distal inner diameter.

The method includes a step of aligning the shield with the firearm suppressor by axially forcing the firearm barrel into the shield. As such, the firearm suppressor engages with the tapered structure, thereby causing the firearm suppressor to funnel into alignment with the shield. Upon discharge, at least some of the residual effects of a firearm discharge are dispersed throughout the shield.

It is an object of the invention to provide a device that further dampens the sound, light, and heat emitted from a firearm including a firearm suppressor. The shield of the present invention can be retrofit to a multitude of firearms and firearm suppressors having various geometries via adjustable dampening components. The shield includes one or more chambers to receive the residual effects of a firearm discharge from the firearm suppressor, thereby dampening the residual effects noticeable exterior to the firearm.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
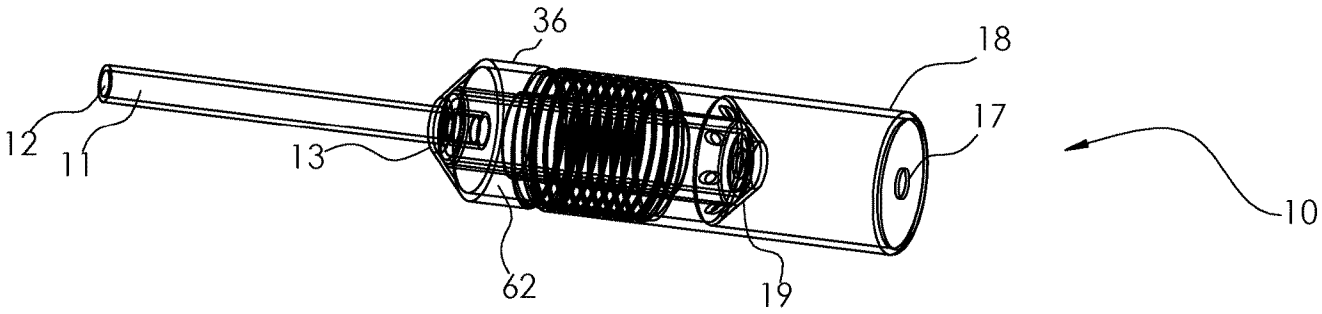
FIG. 1 is a perspective view of a residual effect shield mounted on a firearm suppressor and a firearm barrel.

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention includes a universal residual effect shield configured to mount to a firearm suppressor. While the firearm suppressor decreases the sound, light, and heat emitted by the firearm during discharge, residual effects may still be detectable outside of the firearm. The shield of the present invention includes at least one enclosure adapted to receive residual effects of a firearm discharge, thereby dampening the residual effects detectable outside of the firearm.

Referring to FIGS. 1-6, an embodiment of the shield, generally denoted by reference numeral 10, is depicted. Shield 10 is adapted to ensleeve suppressor 27, thereby surrounding suppressor 27. In order to ensleeve suppressor 27, shield 10 includes proximal enclosure 36 and distal enclosure 18. Each of proximal and distal enclosures 36, 18 is configured to attach to and surround suppressor 27. Moreover, proximal enclosure 36 threadedly engages with distal enclosure 18, forming shield 10 that ensleeves suppressor 27. Shield 10 captures the residual effects of firearm discharge that are not absorbed by suppressor 27.

Figure 2:
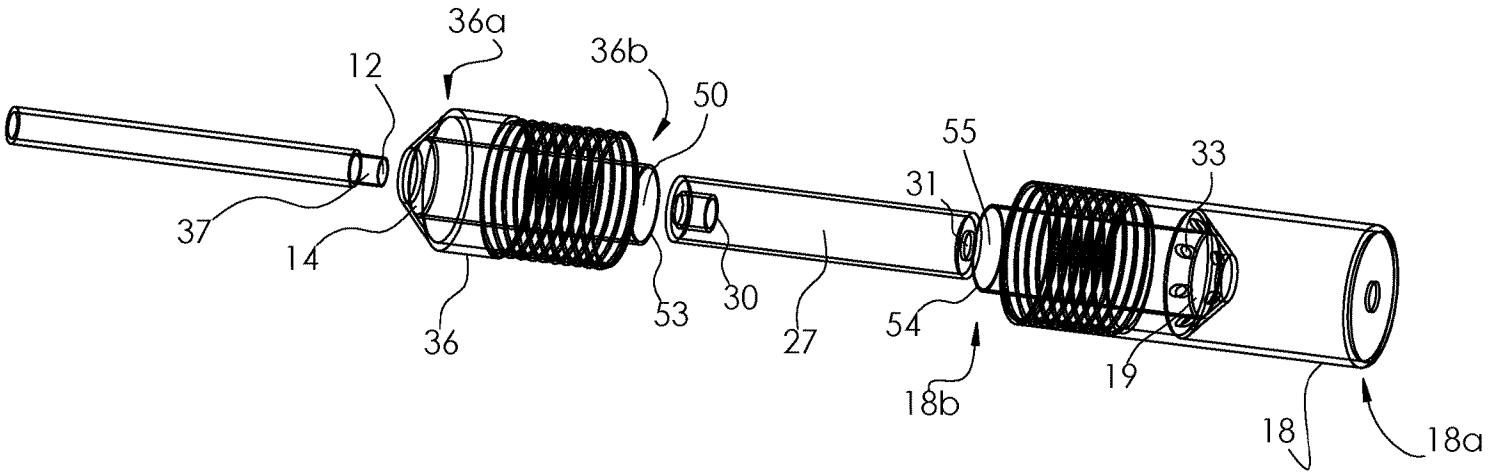
FIG. 2 is an exploded view of the components of FIG. 1.
Figure 3:
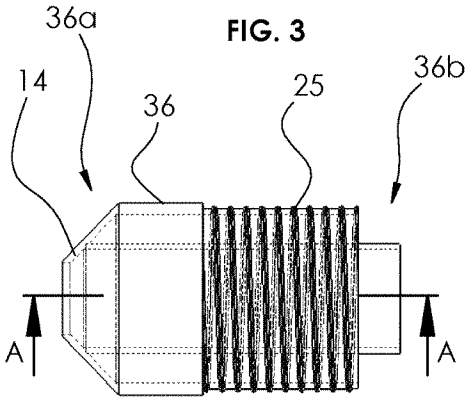
FIG. 3 is a side view of a proximal enclosure of the residual effect shield.
Figure 4:
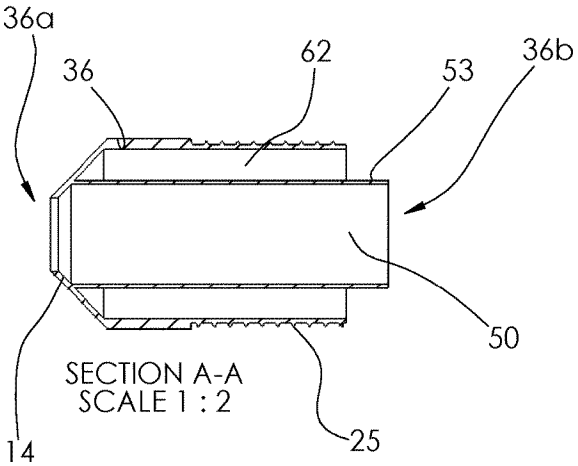
FIG. 4 is a section view of the proximal enclosure of FIG. 3.
Figure 5:
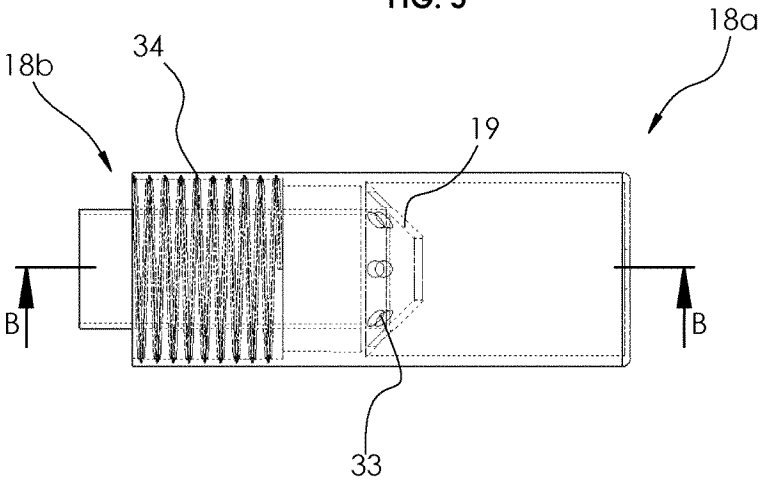
FIG. 5 is a side view of a distal enclosure of the residual effect shield.

As shown in FIGS. 1-2, proximal enclosure 36 includes a proximal end 36*a*, chamber 62, and a distal end 36*b*, with a body disposed between proximal end 36*a* and distal end 36*b*. Proximal end 36*a* is adapted to receipt at least a portion of a firearm barrel 11. Similarly, distal end 36*b* is adapted to mate with suppressor 27. Chamber 62 is disposed within the body of proximal enclosure 36 between proximal end 36*a* and the distal end 36*b*. Chamber 62 surrounds a portion of suppressor 27.

Proximal end 36*a* includes aperture 13. Aperture 13 is sized and shaped to receive at least a portion of barrel 11 therethrough. Accordingly, proximal end 36*a* is in communication with a firearm through barrel 11. Proximal end 36*a* also includes first tapered structure 14. First tapered structure 14 is intended to reside adjacent to suppressor 27 when suppressor 27 is secured within proximal enclosure 36.

As best shown in FIG. 2, suppressor 27 is secured within proximal enclosure 36 when distal end 36*b* receives suppressor 27. Distal end 36*b* includes suppressor receiving envelope 50. A portion of suppressor 27 is inserted into suppressor receiving envelope 50. Suppressor receiving envelope 50 includes lateral circumferential wall 53, which has a diameter slightly greater than a diameter of suppressor 27. As such, a seal is created between suppressor receiving envelope 50 and suppressor 27. Lateral circumferential wall 53 may be lined with rubber or a similar material to enhance the frictional retention of suppressor 27 within suppressor receiving envelope 50. Suppressor 27 includes bore 30, which is sized and shaped to receive extension 37 of barrel 11. Extension 37 includes bore 12, which axially aligns with bore 30 of suppressor 27, allowing a projectile to enter suppressor 27 from barrel 11.

Referring now to FIGS. 1-4, chamber 62 is disposed between proximal end 36*a* and distal end 36*b*, such that chamber 62 surrounds suppressor 27. As such, chamber 62 is in fluid communication with suppressor 27. Upon firearm discharge, some of the residual effects emitted by suppressor 27 are captured by chamber 62. The residual effects are retained within chamber 62 by first tapered structure 14. Accordingly, chamber 62 and first tapered structure 14 are configured to dampen the residual effects noticeable exterior to the firearm.

As shown in FIGS. 1-2 and 5-6, shield 10 includes distal enclosure 18. Distal enclosure 18 includes a distal end 18*a*, chamber 61, and proximal end 18*b*, with a body disposed between distal end 18*a* and proximal end 18*b*. Distal end 18*a* includes projectile aperture 17, and allows for the discharge of a projectile fired from a firearm. Proximal end 18*b* is adapted to mate with suppressor 27, similar to the distal end 36*b* of proximal enclosure 36. Second tapered structure 19 and chamber 61 are disposed within the body and between distal end 18*a* and proximal end 18*b*.

Similar to distal end 36*b* of proximal enclosure 36, proximal end 18*b* of distal enclosure 18 includes suppressor receiving envelope 55. Suppressor 27 is inserted within suppressor receiving envelope 55, creating a seal between the structures. Suppressor receiving envelope 55 includes lateral circumferential wall 54, which may be lined with rubber or a similar material to aid in the frictional retention of suppressor 27.

Figure 6:
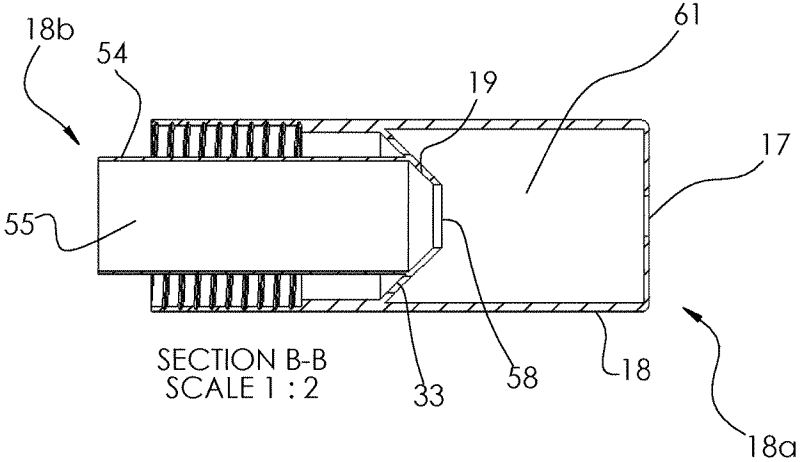
FIG. 6 is a section view of the distal enclosure of FIG. 5.
Figure 7:
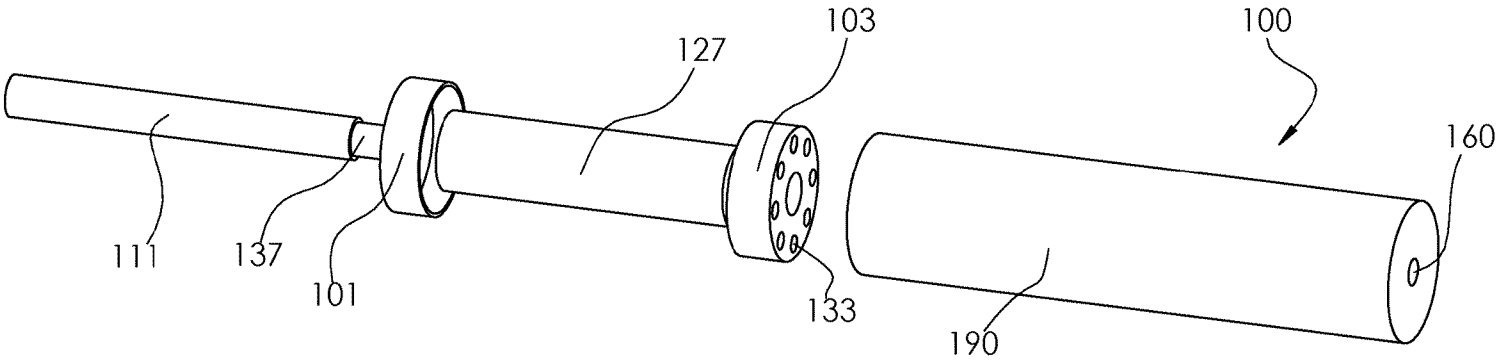
FIG. 7 is a partially disassembled view of a residual effect shield mounted on a firearm suppressor and a firearm barrel.

Distal enclosure 18 includes second tapered structure 19 and chamber 61. Second tapered structure 19 is intended to reside adjacent to suppressor 27 when suppressor 27 is secured within distal enclosure 18. Second tapered structure 19 has a proximal inner diameter that is greater than a distal inner diameter, creating a taper on second tapered structure 19. As such, second tapered structure 19 may be frustoconical in shape. The shape of second tapered structure 19 aligns suppressor 27 with barrel 11, as second tapered structure 19 forces suppressor 27 into an axial alignment due to the tapered sides. Second tapered structure 19 includes bore 58, as shown in FIG. 6. When distal enclosure 18 couples with suppressor 27, bore 58 axially aligns with bore 31 on suppressor 27, thereby allowing a projectile to exit suppressor enter distal enclosure 18.

Second tapered structure 19 is longitudinally spaced from distal end 18*a* of distal enclosure 18, thereby creating chamber 61. Second tapered structure 19 is in fluid communication with chamber 61, such that some of the residual effects from discharge can translate between second tapered structure 19 and chamber 61. In particular, residual effects, such as gases, can disperse through second tapered structure 19 to chamber 61. To enhance the dispersion of residual effects into distal chamber 61, a plurality of fluid channels 33 are disposed on second tapered structure 19. Fluidic channels 33 provide fluid conduits through which gases and other residual effects can disperse. Some of the residual effects of the firearm discharge are dampened as the remaining sound, light, and heat energies are distributed throughout distal enclosure 18, in particular throughout chamber 61.

As shown in FIG. 1, proximal enclosure 36 threadedly engages with distal enclosure 18. Proximal enclosure 36 includes threading 25, best shown in FIG. 3. Distal enclosure includes threading 34, best shown in FIG. 5. Threading 25, 34 is complementary, such that proximal enclosure 36 mates with distal enclosure 18. When coupled, proximal and distal enclosures 36, 18 encase suppressor 27, providing space for the dispersion of the residual effects from firearm discharge. Threading 25, 34 allows for the adjustment of proximal and distal enclosures 36, 18 to accommodate suppressors 27 of varying dimensions. For example, proximal and distal enclosures 36, 18 can be adjusted to be closer together for a smaller suppressor, or can be further apart to accommodate a larger suppressor.

The exploded view of FIG. 2 depicts the alignment of proximal and distal enclosures 36, 18 with suppressor 27 and barrel 11. When suppressor 27 is inserted within suppressor receiver envelopes 50, 55, both proximal enclosure 36 and distal enclosure 18 axially align with suppressor 27, such that the components share a central axis. The alignment is fortified when proximal and distal enclosures 36, 18 threadedly engage. Further, shield 10 aligns with barrel 11, thereby axially aligning projectile aperture 17 with barrel 11 and providing a channel for the uninterrupted lateral trajectory of a projectile during discharge. Accordingly, when shield 10 secures to suppressor 27, a projectile can exit a firearm via barrel 11; enter proximal enclosure 36; travel through suppressor 27; enter distal enclosure 18; and exit through projectile aperture 17.

Referring now to FIGS. 7-12, an embodiment of the shield, generally denoted by reference numeral 100, includes proximal enclosure 101 and distal enclosure 103. Proximal and distal enclosures 101, 103 are adapted to be at least partially encased within housing 190. Proximal enclosure 101 mates with barrel 111 of a firearm, such that extension 137 of barrel 111 is inserted within proximal enclosure 101. Similar to the components of shield 10 described above, proximal and distal enclosures 101, 103 mate with suppressor 127.

Figure 8:
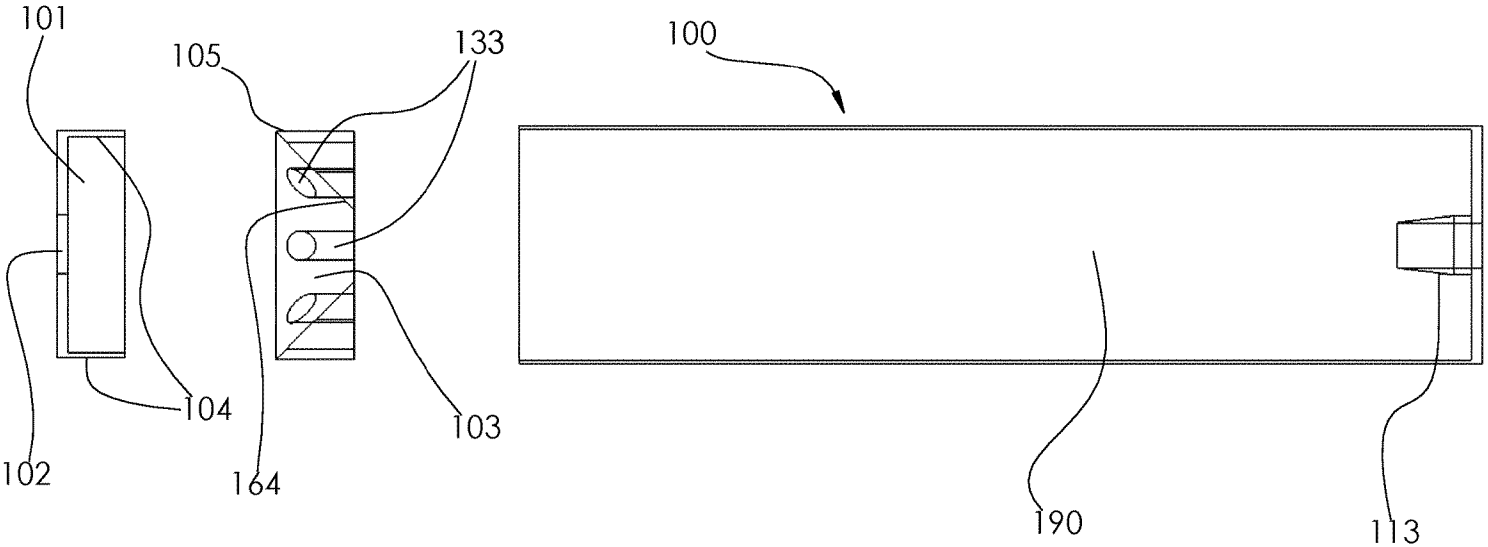
FIG. 8 is a disassembled view of the components of the residual effect shield of FIG. 7.
Figure 9:
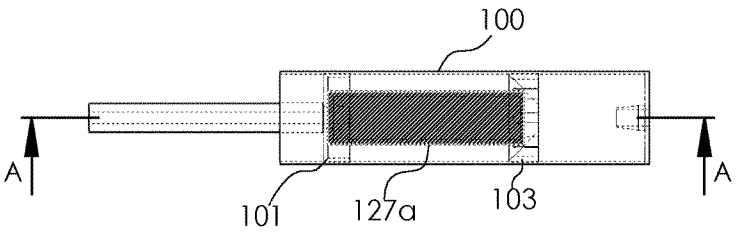
FIG. 9 is a side view of the residual effect shield of FIG. 7 mounted on a small firearm suppressor and a firearm barrel.
Figure 10:
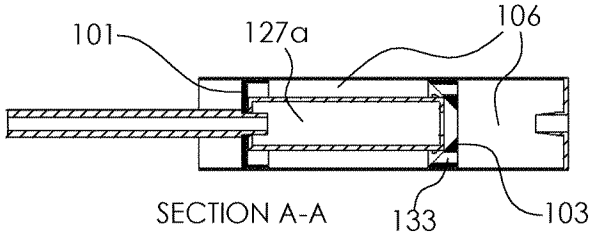
FIG. 10 is a section view of the residual effect shield of FIG. 9.
Figure 11:
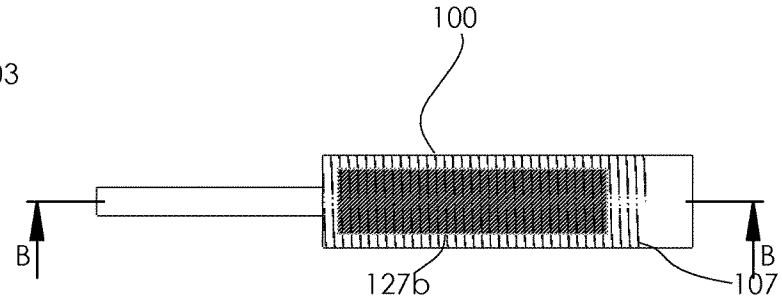
FIG. 11 is a side view of the residual effect shield of FIG. 7 mounted on a large firearm suppressor and a firearm barrel.
Figure 12:
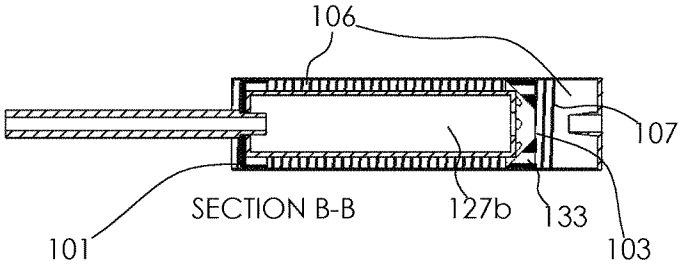
FIG. 12 is a section view of the residual effect shield of FIG. 11.
Figure 13:
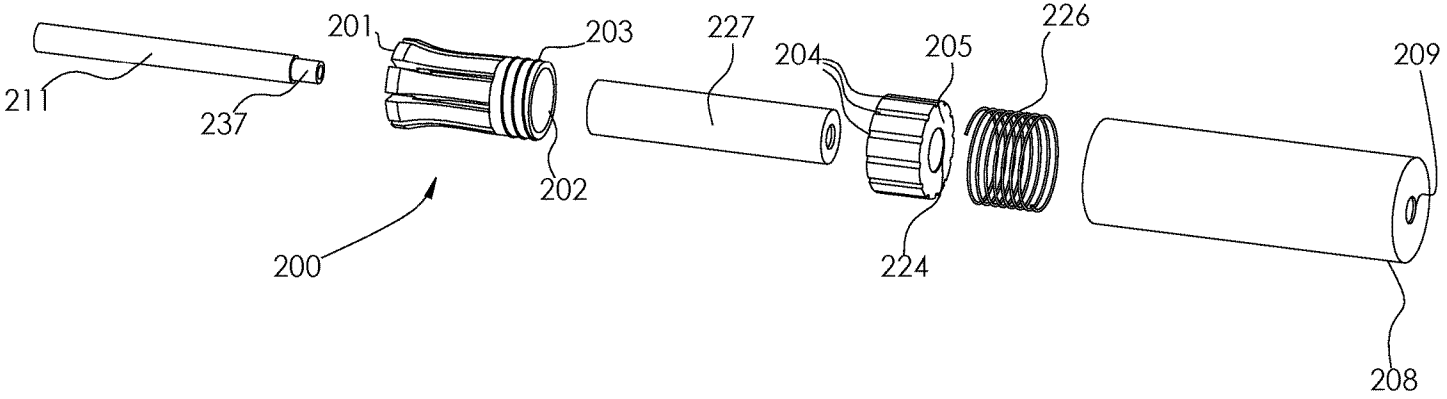
FIG. 13 is an exploded view of a residual effect shield mounted on a firearm suppressor and a firearm barrel.
Figure 18:
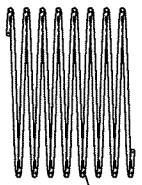
FIG. 18 is a side view of a compression spring, a component of the residual effect shield of FIG. 13.

As shown in FIGS. 8-9, proximal enclosure 101 includes mounting surface 104 and aperture 102. Mounting surface 104 includes a lateral circumferential wall, which has a diameter greater than the diameter of suppressor 127. As such, mounting surface 104 is adapted to engage with suppressor 127, with the lateral circumferential wall of mounting surface 104 engaging with an outer surface of suppressor 127. Mounting surface 104 is slidably adjustable in an axial direction with respect to suppressor 127, thereby accommodating suppressors of varying dimensions. For example, as shown in FIGS. 9-10, proximal enclosure 101 can accommodate a small suppressor 127*a*; similarly, as shown in FIGS. 11-12, proximal enclosure 101 can accommodate a large suppressor 127*b*. Aperture 102 provides a channel through which extension 137 of barrel 111 may be inserted, such that barrel 111 mates with suppressor 127. An outer surface of proximal enclosure 101 includes threading to couple proximal enclosure 101 to housing 190.

Similarly, distal enclosure 103 includes mounting surface 105 and tapered structure 164. Mounting surface 105 is adapted to engage with suppressor 127. Similar to mounting surface 104, mounting surface 105 is slidably adjustable in an axial direction with respect to suppressor 127. Tapered structure 164 is disposed adjacent to suppressor 127, and is frustoconical in shape, such that a distal end of tapered structure 164 has a greater diameter than a proximal end of tapered structure 164. The frustoconical shape of tapered structure 164 axially aligns suppressor 127 with a bore on tapered structure 164. Tapered structure 164 is longitudinally spaced from an end of housing 190. As shown in FIG. 10, the space between tapered structure 164 and the end of housing 190 creates chamber 106. Distal enclosure 103 also includes a plurality of fluidic channels 133 to allow for the dispersion of some of the residual effects into chamber 106. Fluidic channels 133 provide fluid conduits through which gases and other residual effects can disperse into chamber 106. Similar to proximal enclosure 101, an outer surface of distal enclosure 103 includes threading to couple distal enclosure 103 to housing 190.

As shown in FIGS. 7-8 and 11-12, housing 190 includes threading 107 on an interior lateral circumferential wall, projectile aperture 160, and interception device 113. Threading 107 is complementary to the threading on proximal and distal enclosure 101, 103, such that the enclosures threadedly engage with housing 190. As such, proximal and distal enclosures 101, 103 100 secure to housing 190, forming shield 100. The lateral circumferential wall of housing 190 has a diameter that is slightly greater than the diameter of proximal and distal enclosures 101, 103, and much greater than the diameter of suppressor 127. The gap that exists between suppressor 127 and housing 190 creates and extension of chamber 106, allowing some of the residual effects to disperse directly from suppressor 127 into chamber 106.

Projectile aperture 160 of housing 190 allows for the exit of a projectile from a firearm during discharge. Accordingly, projectile aperture 160 is axially aligned with a center axis of barrel 111, allowing for the uninterrupted travel of a projectile from barrel 111 and through projectile aperture 160. Because chamber 106 is disposed adjacent to projectile aperture 160, it is possible that some of the residual effects from firearm discharge would escape through projectile aperture 160 into the environment exterior to the firearm. To prevent the escape of these residual effects through projectile aperture 160, housing 109 includes interception device 113. Interception device 113 is disposed adjacent to projectile aperture 160. When a projectile exits projectile aperture 160, the residual gas and light from the discharge are directed toward interception device 113. Interception device 113 has a distal end and proximal end, and is frustoconical in shape. As such, the distal end has a greater outer diameter than a diameter of the proximal end. The shape of interception device 113 directs gas, heat, and light away from projectile aperture 160, thereby redirecting the residual effects throughout chamber 106. The residual effects noticeable exterior to the firearm are reduced as a result of interception device 113.

To assemble shield 100, both barrel 111 and a proximal end of suppressor 127 are inserted within aperture 102 of proximal enclosure 101. As such, extension 137 of barrel 111 mates with suppressor 127, with proximal enclosure surrounding a portion of suppressor 127. A distal end of suppressor 127 engages with tapered structure 164 on distal enclosure 103, with the frustoconical shape of tapered structure 164 axially aligning suppressor 127 with barrel 111. Proximal and distal enclosures 101, 103 are inserted within housing 190, with housing 190 threadedly engaging with proximal and distal enclosures 101, 103. As shown in FIGS. 9-12, suppressor 127 is disposed within housing 190 when shield 100 is assembled. Distal enclosure 103 is longitudinally-spaced from projectile aperture 160, creating chamber 106. Further, chamber 106 extends throughout the space between suppressor 127 and housing 190. As such, gases and other residual effects from firearm discharge to disperse throughout chamber 106.

Referring now to FIGS. 13-21, an embodiment of the shield, generally denoted by reference numeral 200, is depicted. Shield 200 is adapted to ensleeve suppressor 227, thereby surrounding suppressor 227. In order to ensleeve suppressor 227, shield 200 includes enclosure 208, with includes compression sleeve 202, alignment partition 205, and spring 226. Compression sleeve 202 is adapted to engage with suppressor 227. Compression sleeve also engages with enclosure 208. Alignment partition 205 surmounts a portion of suppressor 227 and provides for adjustments of shield 200 to accommodate suppressors of varying dimensions. To provide for the dispersion of residual effects, shield 200 includes spring 226 that is disposed within enclosure 208 and adjacent to the projectile aperture end of enclosure 208. Spring 226 is biased to apply an axial force against alignment partition 205 in a direction toward barrel 211. The space created by the interaction between spring 226 and alignment partition 205 creates chamber 206, which is adapted to capture the residual effects of firearm discharge that are not absorbed by suppressor 227.

As shown in FIGS. 13-15 and 19-20, compression sleeve 202 is disposed adjacent to barrel 211 and ensleeves suppressor 227. Compression sleeve 202 includes a proximal end, a distal end, and a body extending therebetween. The proximal end includes at least one levered attachment arm 201 and aperture 222. The distal end is adapted to communicate with enclosure 208, and may include threading 203.

Figure 20:
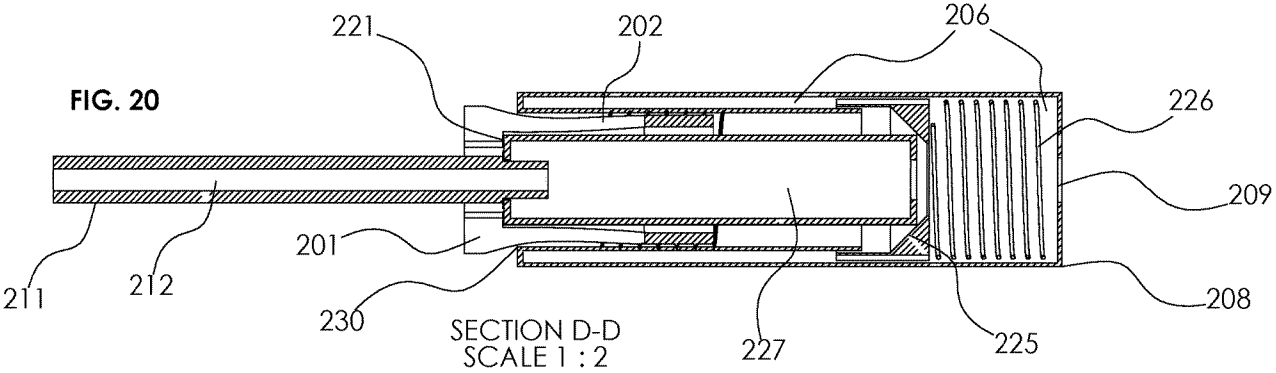
FIG. 20 is a section view of the residual effect shield of FIG. 19.

Attachment arm 201 axially extends in a direction away from the distal end of compression sleeve 202 and toward barrel 211. If more than one attachment arm 201 is included, the attachment arms 201 flare out and are disposed adjacent to suppressor 227. Attachment arm 201 is adapted to translate in a radial direction, such that attachment arm 201 is raised and lowered with respect to suppressor 227 when compression sleeve 202 surrounds suppressor 227. Attachment arm 201 translates within slots 220 in compression sleeve 202 when being radially translated. When lowered, attachment arm 201 rests against securement section 221 and attaches to a proximal end of suppressor 227. Accordingly, attachment arm 201 is adapted to grip suppressor 227, as shown in FIG. 20. By gripping suppressor 227, attachment arm 201 translates suppressor 227 in an axial direction toward the projectile aperture end of enclosure 208.

Referring now to FIGS. 13-14 and 19-21, enclosure 208 is shown in detail. Enclosure 208 includes a proximal end, a distal end, and a body disposed therebetween. The proximal end includes interior receipt 213, which extends along the body. The distal end includes projectile aperture 209. Chamber 206 disposed between interior receipt 213 and projectile aperture 209.

Interior receipt 213 includes inner walls 210, end wall 212, and compression surface 230. Inner walls 210 are disposed at the proximal end of enclosure 208 and extend axially toward the distal end of enclosure 208. At the proximal end of enclosure 208, inner walls 210 include compression surface 230. Compression surface is adapted to mate with another structure and apply a compression force against the structure. End wall 212 is coupled to inner walls 210, forming interior receipt 213. Therefore, end wall 212 is disposed within the body of enclosure 208. Threading 207 is disposed on inner walls 210; the placement of threading 207 will be discussed in greater detail below.

Threading 207 is complementary to threading 203 of compression sleeve 202. As such, compression sleeve 202 threadedly engages with interior receipt 213. As compression sleeve 202 axially translates toward end wall 212, engaging with threading 207, compression sleeve 202 contacts compression surface 230. Compression surface 230 is adapted to radially translate attachment arms 201 toward suppressor 227, such that attachment arms 201 grip suppressor 227. As enclosure 208 is rotated with respect to compression sleeve 202, compression surface 230 forces attachment arms 201 to grip suppressor 227 and axially translate suppressor 227 toward projectile aperture 209.

Figure 21:
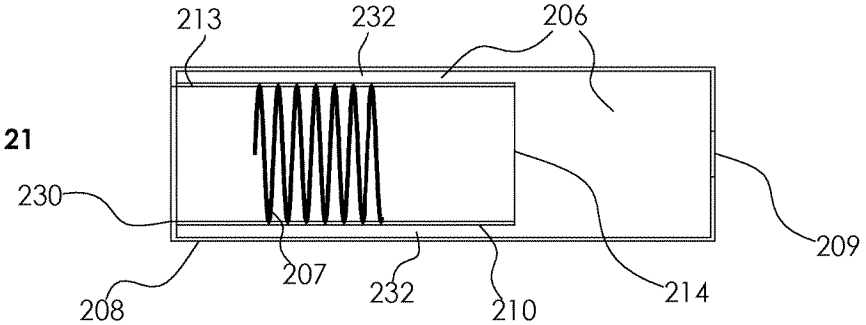
FIG. 21 is an interior view of an enclosure of the residual effect shield of FIG. 13.

As shown in FIG. 21, interior receipt 213 provides channels 232 for the translation of alignment partition 205. Inner walls 210 define an outer diameter, which is smaller than an inner diameter of enclosure 208. The space created by the difference between diameters creates channels 232 along the exterior surface of interior receipt 213.

A portion of chamber 206 is disposed between projectile aperture 209 and end wall 212. Chamber 206 provides a space for the dispersion of residual effects resulting from firearm discharge. Chamber 206 will be discussed in greater detail below.

As shown in FIGS. 13, 16, and 19-20, shield 200 includes alignment partition 205. Alignment partition is disposed within the body of enclosure 208, and is longitudinally-spaced from the distal end of enclosure 208. Alignment partition 205 includes tapered structure 225, fluidic channels 204, and aperture 224.

Figure 19:
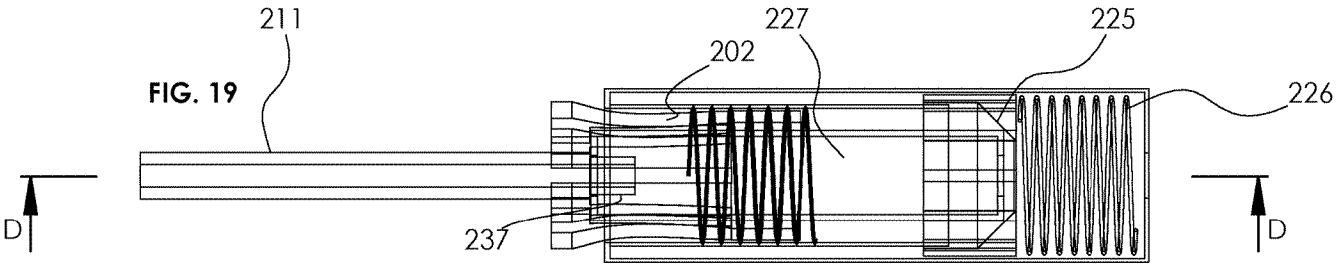
FIG. 19 is a side view of the residual effect shield of FIG. 13 mounted on a firearm suppressor and a firearm barrel.

As depicted in FIGS. 19-20, Alignment partition 205 is adapted to be disposed between end wall 212 and the projectile aperture end of enclosure 208. Alignment partition 205 is adapted to surround a portion of interior receipt 213. As such, alignment partition 205 includes an inner diameter that is slightly greater than the outer diameter of interior receipt 213, but less than the inner diameter of enclosure 208. Alignment partition 205 thereby resides within enclosure 208 while also surrounding interior receipt 213. As shown in FIGS. 19-21, alignment partition 205 can axially translate along interior receipt 213 via channels 232. As such, the location of alignment partition 205 can be adjusted about the length of inner walls 210 to accommodate suppressors of varying lengths. End wall 212 of interior receipt 213 provides a stopping surface for alignment partition 205, such that alignment partition 205 cannot axially translate past end wall 212 toward barrel 211.

Still referring primarily to FIGS. 19-20, tapered structure 225 of alignment partition 205 mates with a distal end of suppressor 227, such that suppressor 227 rests against tapered structure 225. tapered structure 225 is frustoconical in shape such that it aligns suppressor 227 with aperture 224. The frustoconical shape of tapered structure 225 can also increase the dampening of the residual effects of gunfire. When compression sleeve 202 engages with enclosure 208, compression sleeve 202 and alignment partition 205 compress against the ends of suppressor 227. Alignment partition 205 exerts a force against suppressor 227 in an axial direction toward barrel 211. Similarly, compression sleeve 202 axially pulls suppressor 227 toward projectile aperture 209, as discussed above. As such, compression sleeve 202 and alignment partition 205 exert axial forces against suppressor 227 in opposite directions, such that shield 200 grips both ends of suppressor 227. The forces exerted by compression sleeve 202 and alignment partition 205 also axially align suppressor 227 with barrel 211 and projectile aperture 209.

Figure 17:
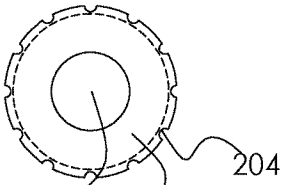
FIG. 17 is an end view of the alignment partition of FIG. 16.
Figure 16:
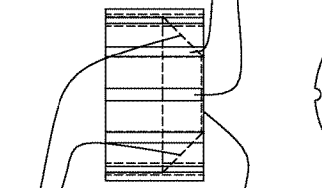
FIG. 16 is a side view of an adjustable alignment partition on the residual effect shield of FIG. 13.
Figure 15:
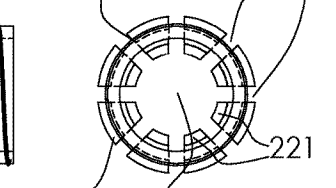
FIG. 15 is an end view of the compression sleeve of FIG. 14.
Figure 14:
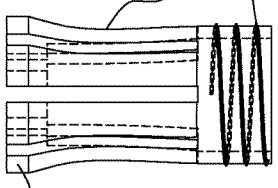
FIG. 14 is a side view of a compression sleeve on the residual effect shield of FIG. 13.

As shown in FIGS. 16-17, alignment partition 205 also includes fluidic channels 204, allowing some of the residual effects to disperse into chamber 206 through the fluidic channels 204. Aperture 224 axially aligns with suppressor 227, such that a projectile can exit alignment partition 205 and travel toward the projectile aperture end of enclosure 208.

As shown in FIGS. 13 and 18-20, shield 200 includes spring 226. Spring 226 is disposed against the distal end of enclosure 208, adjacent to projectile aperture 209, when shield 200 mates with suppressor 227. Spring 226 is in communication with alignment partition 205, such that alignment partition 205 at least partially compresses spring 226 when shield 200 mates with suppressor 227. Spring 226 also forces alignment partition 205 toward suppressor 227, thereby aligning suppressor 227 with barrel 211. Together with compression sleeve 202, spring 226 ensures that suppressor 227 is secured in place within shield 200.

The interaction between spring 226 and alignment partition 205 creates chamber 206, which receives some of the residual effects of firearm discharge. The size of chamber 206 is determined by the compression of spring 226, which in turn is determined by the location of suppressor 227 within enclosure 208. The location of suppressor 227 is determined by the interaction between compression sleeve 202 and interior receipt 213. Specifically, the engagement between compression sleeve 202 and threading 207 causes suppressor 227 to axially translate away from barrel 211. The axial translation of suppressor 227 compresses spring 226. To ensure that spring 226 does not compress so much that chamber 206 is not created, threading 207 is disposed on a middle portion of interior receipt 213.

As shown in FIGS. 19-20, each of the components of shield 200 function to axially align barrel 211 with projectile aperture 209 of enclosure 208, such that a projectile can be fired through barrel 211 and exit through projectile aperture 209. Extension 237 of barrel 211 is inserted within compression sleeve 202. Barrel 211 mates with suppressor 227 within compression sleeve 202, such that extension 237 is inserted within suppressor 227. As such, suppressor 227 has an inner diameter that is slightly greater than the outer diameter of extension 237, so that suppressor 227 can receive extension 237. The difference between the diameters of suppressor 227 and extension 237 is best shown in FIG. 20, wherein reference numeral 212 generally describes the bore of barrel 211. The interaction described above between attachment arm 201, suppressor 227, alignment partition 205, and spring 226 causes shield 200 to axially align with suppressor 227. As such, barrel 211, suppressor 227, and shield 200 axially align, such that projectile aperture 209 aligns with bore 212 of barrel 211. The axial alignment of the component parts of shield 200 with suppressor 227 and barrel 211 provides a channel through which a projectile can be discharged.

Figure 22:
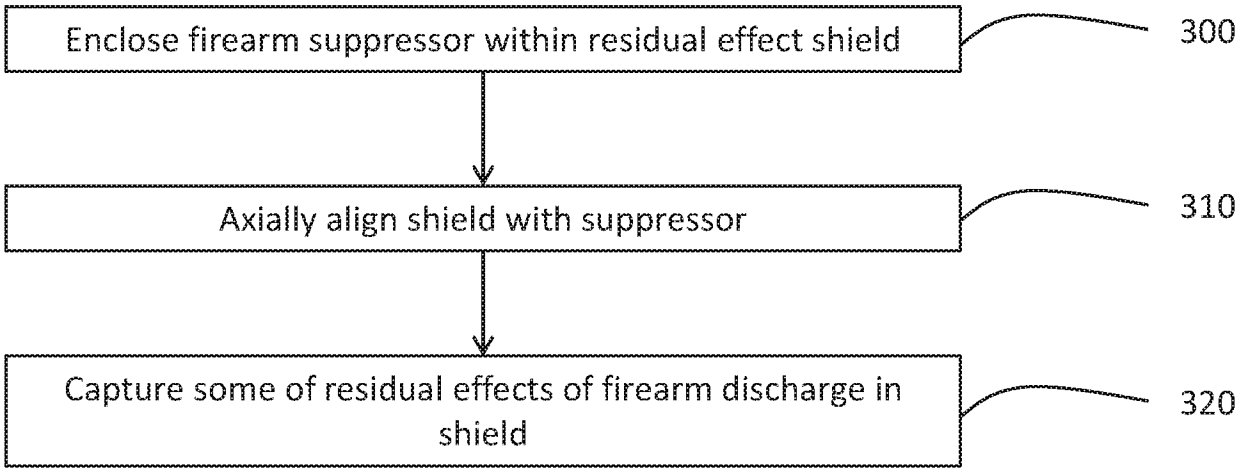
FIG. 22 is a process-flow diagram of a method of dampening the residual effects of a firearm discharge from a firearm suppressor.

Referring now to FIG. 22, in conjunction with FIGS. 13-21, an exemplary process-flow diagram is provided, depicting a method of dampening the residual effects of a firearm discharge from a firearm suppressor. The steps delineated in the exemplary process-flow diagram of FIG. 22 are merely exemplary of an order of dampening residual effects using an embodiment of a shield. The steps may be carried out in another order, with or without additional steps included therein. Additionally, the steps may be carried out with an alternative embodiment of a shield, as contemplated in the description above.

The method of dampening residual effects of firearm discharge begins at step 300, which includes enclosing firearm suppressor 227 within shield 200. Suppressor 227 is mated to a portion of barrel 211, such as extension 237. Shield 200 includes a proximal portion opposite a distal portion. The distal portion includes projectile aperture 209 and tapered structure 225. Tapered structure 225 is longitudinally-spaced from projectile aperture 209, such that tapered structure 225 is disposed between projectile aperture 209 and barrel 211. Tapered structure 225 has a proximal inner diameter that is greater than a distal inner diameter.

The method proceeds to step 310, which includes aligning shield 200 with suppressor 227. The alignment is step is accomplished by axially forcing barrel 211 into shield 200, such that suppressor 227 engages with tapered structure 225 disposed at the distal portion of shield 200. By forcing suppressor 227 to engage with tapered structure 225, suppressor 227 funnels into alignment with shield 200.

When shield 200 couples to suppressor 227, shield 200 substantially surrounds suppressor 227. Upon a firearm discharge, a portion of the effects of the discharge are captured by suppressor 227. However, suppressor 227 may not capture all of the effects from discharge, leaving residual effects that either escape the firearm, or are retained by another component. Shield 200 is adapted to capture at least some of the residual effects of the discharge. During step 320, some of the residual effects from discharge are dispersed throughout shield 200. As such, shield 200 dampens the residual effects noticeable in the environment exterior to the firearm.

Glossary of Claim Terms

Compression Surface: is a surface adapted to exert a force against a second surface, such that the second surface translates as a result of the contact with the compression surface.

Exterior Environment: is the space surrounding a structure, through which audible and visual effects can be detected.

Firearm Barrel: is a discharging tube of a firearm, including any extension or aftermarket addition.

Firearm Suppressor: is a device having a plurality of baffles that attaches to a firearm and reduces the amount of detectable noise, light, and heat generated by firing the firearm.

Fluidic Channel: is channel adapted to allow the flow of fluids between two chambers.

Levered Attachment Arm: is a structure that is adapted to radially translate with respect to a firearm suppressor. The levered attachment arm is actuated by another structure, such as the compression surface.

Residual Effect: is an audible or visual effect of a firearm discharge that may be noticeable after being reduced by a firearm suppressor.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A residual effect shield used in combination with a firearm suppressor, the shield comprising:
- a proximal enclosure, the proximal enclosure having:
  - a proximal end, a distal end, and a body disposed therebetween;
  - the proximal end including an aperture sized to receive a portion of a firearm barrel;
- a distal enclosure, the distal enclosure having:
  - a distal end, a proximal end, and a body extending therebetween;
  - the distal end having a projectile aperture;
  - a tapered structure disposed within the body of the distal enclosure and longitudinally-spaced from the distal end to create a distal chamber, the tapered structure having a proximal inner diameter that is greater than a distal inner diameter;
- the proximal enclosure and the distal enclosure configured to attach to each other in an axially aligned configuration;
- each of the proximal and distal enclosures having an inner diameter that is greater than an outer diameter of the firearm suppressor when the residual effect shield at least partially ensleeves the firearm suppressor; and
- whereby at least some residual effects of a firearm discharge are dispersed throughout the proximal and distal enclosures.

2. The shield of claim 1, further comprising complementary threading on the proximal enclosure and the distal enclosure, wherein the proximal enclosure and the distal enclosure threadedly mate via the complementary threading.

3. The shield of claim 1, wherein the tapered structure is frustoconical in shape, such that the tapered structure is adapted to mate with the firearm suppressor, thereby aligning the firearm suppressor with the firearm barrel and the projectile aperture.

4. The shield of claim 1, wherein the tapered structure further comprises a fluidic channel extending therethrough, thereby enabling fluid in the distal chamber to pass through the tapered structure.

5. A residual effect shield used in combination with a firearm suppressor, the shield comprising:
- an enclosure housing a compression sleeve, a spring, and an alignment partition, the enclosure having:
  - a proximal end, a distal end, and a body disposed therebetween;
  - the distal end including a projectile aperture;
- the compression sleeve including:
  - a proximal end, a distal end, and a body extending therebetween;
  - the proximal end including:
    - an aperture sized to receive a portion of a firearm barrel;
    - at least one attachment arm adapted to translate in a radial direction;
  - the distal end of the compression sleeve in communication with the body of the enclosure;
- the spring disposed at the distal end of the enclosure, the spring adapted to exert a force against the alignment partition in an axial direction toward the proximal end of the enclosure;
- the alignment partition disposed within the body of the enclosure and longitudinally-spaced from the distal end of the enclosure via the spring thereby creating a chamber, such that the alignment partition is adapted to contact a distal end of the firearm suppressor;
- whereby at least some of the residual effects of a firearm discharge are dispersed throughout the chamber.

6. The shield of claim 5, wherein the at least one attachment arm is configured to radially translate to grip a proximal end of the firearm suppressor.

7. The shield of claim 6, wherein the compression sleeve is adapted to exert a force against the firearm suppressor in an axial direction toward the distal end of the enclosure, whereby the compression sleeve and the alignment partition are configured to align the firearm suppressor with the firearm barrel and the projectile aperture.

8. The shield of claim 5, wherein the alignment partition further comprises a tapered structure, the tapered structure having a proximal inner diameter that is greater than a distal inner diameter, the tapered structure configured to engage with the distal end of the firearm suppressor.

9. The shield of claim 8, wherein the distal inner diameter is greater than or equal to an outer diameter of the firearm suppressor.

10. The shield of claim 8, wherein the tapered structure is frustoconical in shape, such that the tapered structure is adapted to align the firearm suppressor with the firearm barrel and the projectile aperture.

11. The shield of claim 5, wherein the alignment partition further comprises a fluidic channel extending therethrough, thereby enabling fluid in the chamber to pass through the alignment partition.

12. The shield of claim 5, wherein the enclosure further comprises an interior receipt, the interior receipt having an outer diameter that is smaller than an inner diameter of the enclosure, thereby creating a translation channel between the enclosure and the interior receipt.

13. The shield of claim 12, wherein the alignment partition is adapted to axially translate along the translation channel.

14. The shield of claim 12, wherein the translation channel is in fluid communication with the chamber, thereby enabling fluid in the chamber to disperse into the translation channel.

15. The shield of claim 5, wherein the body of the enclosure further comprises a threaded portion, and wherein the distal end of the compression sleeve further comprises a threaded portion complementary to the threaded portion of the enclosure, whereby the compression sleeve is adapted to threadedly engage with the enclosure.

* * * * *